US005795546A

United States Patent [19]

Amelung

[11] Patent Number: 5,795,546

[45] Date of Patent: Aug. 18, 1998

[54] STORAGE CONTAINER FOR VESSELS

[75] Inventor: Rolf Amelung, Lemgo, Germany

[73] Assignee: Heinrich Amelung GmbH, Lemgo, Germany

[21] Appl. No.: 763,410

[22] Filed: Dec. 11, 1996

[30] Foreign Application Priority Data

Dec. 15, 1995 [DE] Germany ..... 195 46 894.5

[51] Int. Cl.[6] ..... B01L 3/00; B65D 43/04

[52] U.S. Cl. ..... 422/102; 422/104; 220/256; 220/351; 220/526; 206/438

[58] Field of Search ..... 422/58, 61, 66, 422/99, 102, 104; 221/227, 279; 414/417; 53/543; 220/526, 256, 351; 206/438

[56] References Cited

U.S. PATENT DOCUMENTS

| | | | |
|---|---|---|---|
| 3,174,637 | 3/1965 | Flynn | 414/417 |
| 3,393,688 | 7/1968 | Saverino | 221/279 |
| 3,767,084 | 10/1973 | Bayha | 221/279 |
| 3,960,270 | 6/1976 | May | 206/256 |
| 4,269,326 | 5/1981 | Delbrouck | 221/227 |
| 4,344,523 | 8/1982 | May et al. | 221/279 |
| 4,465,208 | 8/1984 | Buban et al. | 221/279 |
| 4,572,365 | 2/1986 | Bruno et al. | 206/306 |
| 4,583,657 | 4/1986 | Finn | 211/59.3 |
| 4,729,481 | 3/1988 | Hawkinson et al. | 211/59.3 |
| 4,730,730 | 3/1988 | Clarkson | 206/497 |
| 4,742,936 | 5/1988 | Rein | 221/5 |
| 5,251,778 | 10/1993 | Eggl | 220/526 |
| 5,251,783 | 10/1993 | Gringer | 221/102 |
| 5,353,956 | 10/1994 | Wilson | 221/198 |

*Primary Examiner*—Harold Y. Pyon
*Attorney, Agent, or Firm*—Henry M. Feiereisen

[57] ABSTRACT

A storage container for measuring vessels containing fluids to be tested, such as blood, blood plasma or the like; includes a housing having an interior space for accommodating the measuring vessels which are arranged within the housing in rows. The housing is formed with openings formed laterally outside a covering area of the vessels and includes a rear wall and a front wall which exhibits an ejection slot for extraction of the vessels. In order to allow a displacement of the rows of vessels toward the ejection slot, an ejector is insertable through the openings to act on a guide rail that extends between a rearmost row of vessels and the rear wall, to thereby move the guide rail and thus the vessels in direction toward the ejection slot.

3 Claims, 1 Drawing Sheet

STORAGE CONTAINER FOR VESSELS

BACKGROUND OF THE INVENTION

The present invention refers to a storage container for vessels, and in particular to a storage container for containment of measuring vessels of the type having an open inlet end for receiving fluids to be tested such as blood, blood plasma or the like.

U.S. Pat. No. 5,251,778 discloses a storage container having a front face formed with an ejection slot and a top side formed with spaced and parallel rectangular openings, with the open end of the vessels facing the top side. In order to prevent a penetration of dust or other impurities into the open vessels, a sheet is removably secured between the top side of the housing and the vessels so as to cover the open ends of the vessels. Although this type of storage container has been generally successfully commercialized, the use of the interposed sheet poses a problem because dust accumulating in the area of the openings, especially during extended storage period, drops into the vessels when the sheet is pulled out so that the measuring result may be adversely affected. Moreover, in the event the vessels are charged with spheres, the sheet may become eletrostatically charged and thereby attract the spheres which then are forced out of the vessels. Thus, the spheres are no longer suitable for their intended use, and ultimately a shut down of the measuring testing apparatus can be encountered.

In general, the side walls of this conventional storage container are welded together by ultrasound, once the measuring vessels are disposed in the container and the sheet is positioned in place. This poses the risk that the sheet, too, may be welded to the side walls of the container, thereby preventing a secure and easy removal of the sheet.

SUMMARY OF THE INVENTION

It is thus an object of the present invention to provide an improved storage container, obviating the afore-stated drawbacks.

In particular, it is an object of the present invention to provide an improved storage container which eliminates the risk of contamination of the measuring vessels and ensures their use suitable for every application.

These objects, and others which will become apparent hereinafter, are attained in accordance with the present invention by providing a housing for accommodating and covering the measuring vessels arranged in rows, with the housing being formed with openings arranged laterally outside a covering area of the vessels and including a front wall formed with an ejection slot for discharge of the vessels and a rear wall, and by providing an ejector unit for shifting the rows of vessels toward the ejection slot, with the ejector unit including a guide rail extending between a rearmost row of vessels and the rear wall, and an ejector insertable through the openings and acting on the guide rail for moving the guide rail in direction toward the ejection slot.

The provision of a storage container in accordance with the present invention allows a complete covering of the inlet openings of the vessels by the housing top, to thereby eliminate the need for a separate sheet. Moreover, as the open ends of the vessels are not exposed at any time until actual use of the vessels, there is no possibility for dust to reach the vessels. Thus, the accuracy and safety of the measurement is considerably enhanced. Also the adverse effect of electrostatic charging that attracts spheres inside the measuring vessels, and the unintentional welding of a sheet to the housing side walls are eliminated. Naturally, the elimination of a sheet also renders the use of the storage container more cost efficient, as the necessity of producing and disposing such sheets is avoided.

Preferably, the openings are formed on the broadside-defining top side of the housing at the marginal areas in close proximity to the end faces of the housing and terminate in slots formed at the rear wall of the housing. Suitably, the slots in the rear wall are so dimensioned as to allow a secure insertion of the ejector and displacement of the guide rail by the ejector toward the ejection slot.

In accordance with another embodiment of the invention, the openings are formed solely in the rear wall to provide access for the ejector to the guide rail. Thus, the storage container essentially forms a completely enclosed interior space that is only interrupted by the rear slots and the front ejection slot.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
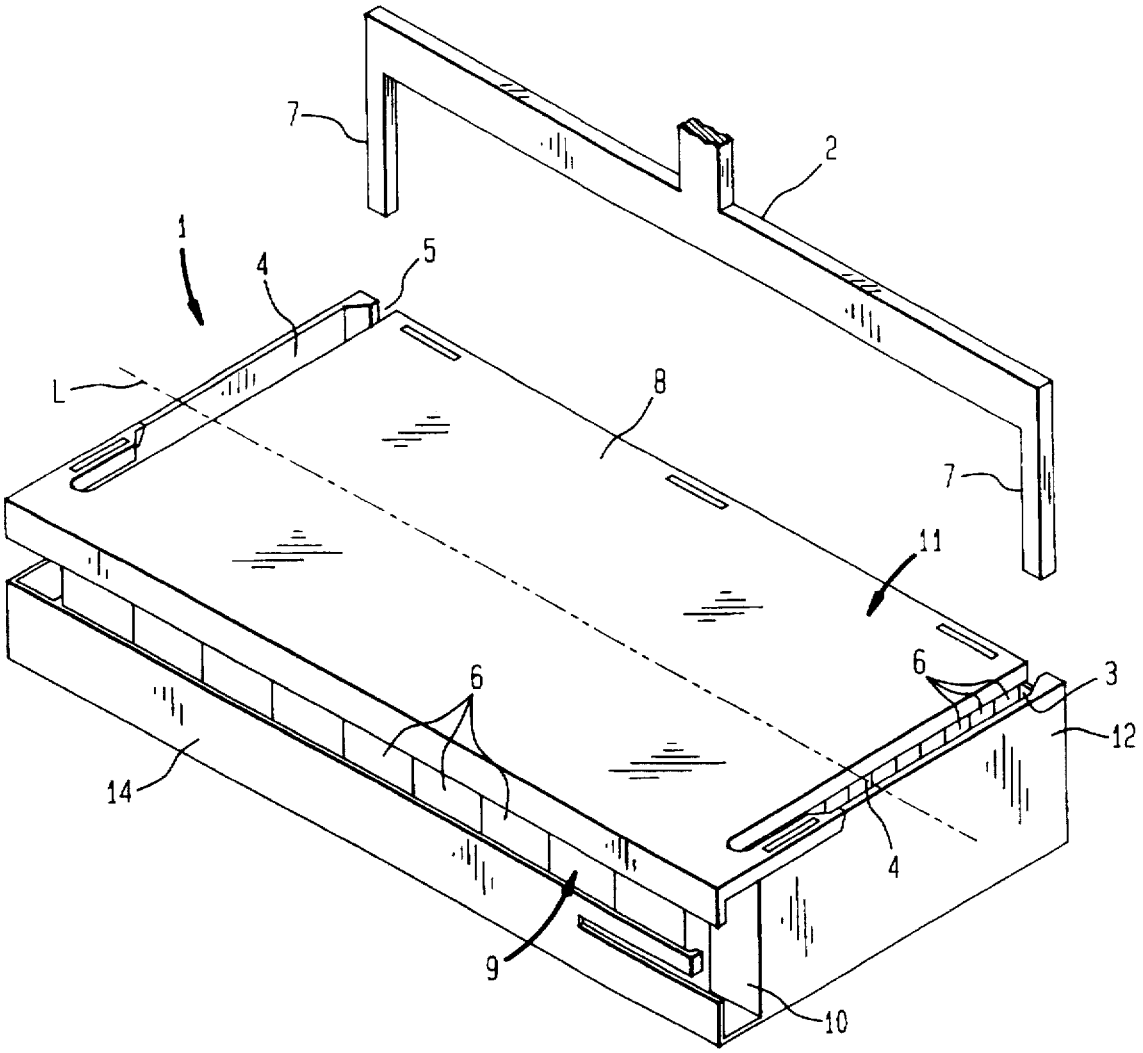
FIG. 1 is a perspective view of a storage container according to the present invention.

Throughout all the Figures, the same or corresponding elements are always indicated by the same reference numerals.

Turning now to the drawing, and in particular to FIG. 1, there is shown a perspective view of a storage container according to the present invention, generally designated by reference numeral 1 for containment of a plurality of block-shaped graduated vessels 6 for receiving fluids to be tested, such as blood, blood plasma, or the like. The storage container I includes a housing 11 of generally rectangular cross section and is formed by two parallel side panels 12, parallel narrow-side defining rear wall 13 and front wall 14, and parallel broad-side defining top 8 and bottom 15 to define an interior space in which the vessels 6 are placed side-by-side in successive rows.

Figure 2:
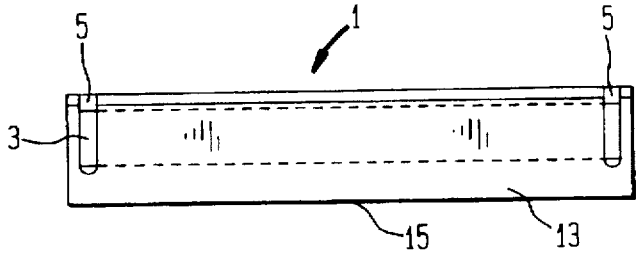
FIG. 2 is a rear view of the storage container of FIG. 1.

The top 8 of the housing 11 of the storage container 1 is formed with two elongated slotted openings 4 in spaced-apart parallel disposition transversely to the longitudinal axis L of the housing 11. The openings 4 are disposed laterally outside the area of the top 8 covering the vessels 6 in immediate proximity of the marginal area of the top side 8 next to the respective end faces of the storage container 1 and extend toward the rear side of the housing 11 to terminate in generally vertical slots 5 formed in the rear wall 13 of the housing 11, as shown in FIG. 2. Extending along the front wall of the housing 11 is an ejection slot 9 which terminates at one axial end face of the housing 11 in an outlet 10 through which the vessels 6 are extracted one-by-one and transferred to an analyzer (not shown).

Insertable in the openings 4 of the top 8 and slots 5 of the rear wall 13 are prongs 7 of a key-like ejector 2 for actuation of a guide rail 3 that is slidably retained in parallel disposition to the longitudinal axis L between the rearmost row of vessels 6 and the rear wall 15 and extends along the entire length of the housing 11 between the side panels 12, as shown in FIG. 2. In order to position the foremost row of the vessels 6 in the ejection slot 2 for extraction of the vessels 6 through the outlet 10, the prongs 7 of the ejector 2 is inserted from behind through the slots 5 to bear against the guide rail 3 and subsequently pushed in direction toward the ejection slot 9, with the ejector 2 entering the openings 4 and being guided therein during displacement of the guide rail 3 and the rows of vessels 6 in direction of the ejection slot 9.

Throughout their retention within the housing 11, the block-shaped vessels 6 are completely covered by the top 8, with their inlet openings (not shown) facing the top 8 as the openings 4 and the slots 5 are located laterally outside of the rows of vessels 6.

Although not shown in the drawing, persons skilled in the art will understand that the ejector may also be formed with prongs 7 of extended length so that the guide rail 3 can be pushed by the ejector for discharge of the vessels 6, without requiring the provision of openings 4, as shown in FIG. 1. In this case, only the slots 5 are provided in the rear wall 13 to allow access for the ejector 2.

While the invention has been illustrated and described as embodied in a storage container for vessels, it is not intended to be limited to the details shown since various modifications and structural changes may be made without departing in any way from the spirit of the present invention.

What is claimed as new and desired to be protected by Letters Patent is set forth in the appended claims:

1. A storage container for measuring vessels containing fluids to be tested, such as blood, blood plasma; comprising:

a housing having an interior space for accommodating a plurality of measuring vessels arranged in rows, said housing having a top surface covering the vessels and provided with openings formed laterally in the top surface outside an area of the vessels covered by the top surface, said housing further including a rear wall and a front wall which exhibits an ejection slot for discharge of single vessels; and ejector means for displacing the rows of vessels toward the ejection slot, said ejector means including a guide rail extending across and behind a rearmost row of vessels between the rearmost row of vessels and the rear wall, and an ejector insertable through the openings and acting on the guide rail for moving the guide rail in direction toward the discharge slot, thereby shifting the rows of vessels in direction toward the ejection slot.

2. The storage container of claim 1 wherein the housing has opposite end faces spaced from each other in a longitudinal direction, said openings being arranged in a marginal area of the top surface adjacent the end faces of the housing and terminating in slots formed in the rear wall.

3. The storage container of claim 1 wherein the openings are formed only in an area of the rear wall which defines a narrow side of the housing.

* * * * *